US006942503B2

(12) United States Patent
Yamaguchi et al.

(10) Patent No.: US 6,942,503 B2
(45) Date of Patent: Sep. 13, 2005

(54) ELECTRICAL CONNECTOR WITH GROUNDED SHUTTER MEMBER

(75) Inventors: Kenichi Yamaguchi, Sagimihara (JP); Mitsuo Fujikura, Sagimihara (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/505,181

(22) PCT Filed: Feb. 26, 2003

(86) PCT No.: PCT/US03/05915

§ 371 (c)(1),
(2), (4) Date: Apr. 4, 2005

(87) PCT Pub. No.: WO03/073559

PCT Pub. Date: Sep. 4, 2003

(65) Prior Publication Data

US 2005/0164544 A1 Jul. 28, 2005

(30) Foreign Application Priority Data

Feb. 26, 2002 (JP) ..... 2002-049030

(51) Int. Cl.[7] ..... H01R 13/44

(52) U.S. Cl. ..... 439/141; 439/140; 439/181

(58) Field of Search ..... 439/137, 138, 439/140, 141, 181, 607

(56) References Cited

U.S. PATENT DOCUMENTS

| | | | | | |
|---|---|---|---|---|---|
| 4,955,817 | A * | 9/1990 | Sugai | ..... | 439/140 |
| 5,167,516 | A * | 12/1992 | Tan et al. | ..... | 439/141 |
| 5,716,224 | A * | 2/1998 | Masuda et al. | ..... | 439/138 |
| 6,109,939 | A * | 8/2000 | Kondo et al. | ..... | 439/181 |
| 6,685,362 | B2 * | 2/2004 | Burkholder et al. | ..... | 439/607 |

* cited by examiner

*Primary Examiner*—Tho D. Ta
(74) *Attorney, Agent, or Firm*—Stephen Z. Weiss

(57) ABSTRACT

An electrical connector includes a dielectric housing having a receptacle for receiving a complementary mating connector. A plurality of conductive terminals are mounted on the housing and have contact portions exposed in the receptacle for engaging appropriate contacts of the mating connector. A metal shell is disposed about at least a portion of the housing. A shutter plate is movably mounted on the housing for movement between a closed position and an open position. In the closed position, the shutter plate substantially closes the receptacle to prevent inadvertent engagement of foreign objects with the contact portions of the terminals. In the open position, the shutter plate allows mating of the complementary mating connector. At least a portion of the shutter plate is conductive to dissipate static electricity at the receptacle. At least one spring is mounted on the housing for biasing the shutter plate toward its closed position. The spring is conductive and is electrically coupled between the conductive portion of the shutter plate and the metal shell to ground the plate to the shell.

6 Claims, 4 Drawing Sheets

ELECTRICAL CONNECTOR WITH GROUNDED SHUTTER MEMBER

FIELD OF THE INVENTION

This invention generally relates to the art of electrical connectors and, particularly, to an electrical connector which includes a grounded shutter member for closing a mating receptacle of the connector.

BACKGROUND OF THE INVENTION

Many electrical connectors include a dielectric housing having an opening or receptacle for receiving a complementary mating connector. A plurality of conductive terminals have contact portions exposed at or in the receptacle for engaging appropriate contacts of the mating connector. An example of such a connector is used in a portable information, terminal which facilitates connection to a parent device such as a computer.

One of the problems with electrical connectors having receptacles that expose terminals is that the contact portions of the terminals may be engaged by an operator's fingers or other foreign objects which may cause damage to or deformation of the terminals. In order to alleviate this problem, some such electrical connectors are provided with protective covers or shutters which close the mating receptacle and are movable to open positions during mating. For instance, the covers or shutters may be pivotally mounted on the housing. Examples of such connectors are shown in Japan Patent Laid-Open No. 8-203594 and Utility Model Laid-Open No. 5-1175. Another connector has a spring biased moveable cover as shown in U.S. Pat. No. 5,167,515.

Another problem with such connectors is the damage that can be caused to interior components by static electricity. For instance, a portable information terminal has integrated circuits and electronic parts installed therein. When the terminal is connected to the parent device, such as the computer, static electricity during mating can cause problems to the interior components. The present invention is directed to solving these various problems by providing an electrical connector with at least one movable shutter member for closing the receptacle of the connector as well as dissipating static electricity during mating.

SUMMARY OF THE INVENTION

An object, therefore, of the invention is to provide a new and improved electrical connector having a shutter member and which, additionally, is designed for dissipating static electricity.

In the exemplary embodiment of the invention, the connector includes a dielectric housing having a receptacle for receiving a complementary mating connector. A plurality of conductive terminals are mounted on the housing and have contact portions exposed in the receptacle for engaging appropriate contacts of the mating connector. A metal shell is disposed about at least a portion of the housing. A shutter plate is movably mounted on the housing for movement between a closed position substantially closing the receptacle to prevent inadvertent engagement of foreign objects with the contact portions of the terminals, and an open position allowing mating of the complementary mating connector. At least a portion of the shutter plate is conductive to dissipate static electricity at the receptacle. At least one spring is mounted on the housing for biasing the shutter plate toward its closed position. The spring is conductive and is electrically coupled between the conductive portion of the shutter plate and the metal shell to ground the plate to the shell.

According to one aspect of the invention, the spring comprises a coil spring having opposite ends maintained in engagement with the conductive portion of the shutter plate and the metal shell. As disclosed herein, the shutter plate is elongated, and a pair of the coil springs are located at opposite ends of the elongated shutter plate.

According to another aspect of the invention, the shutter plate includes a dielectric core, and the conductive portion of the shutter plate comprises a metal cover over at least part of the core. The dielectric core includes an inside face which faces the contact portions of the terminals.

According to a further aspect of the invention, at least one of the terminals is provided as a ground terminal and is in engagement with the conductive portion of the shutter plate, thereby coupling the ground terminal, via the conductive spring, to the metal shell. The conductive portion of the shutter plate includes a foot extending into engagement with the at least one ground terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
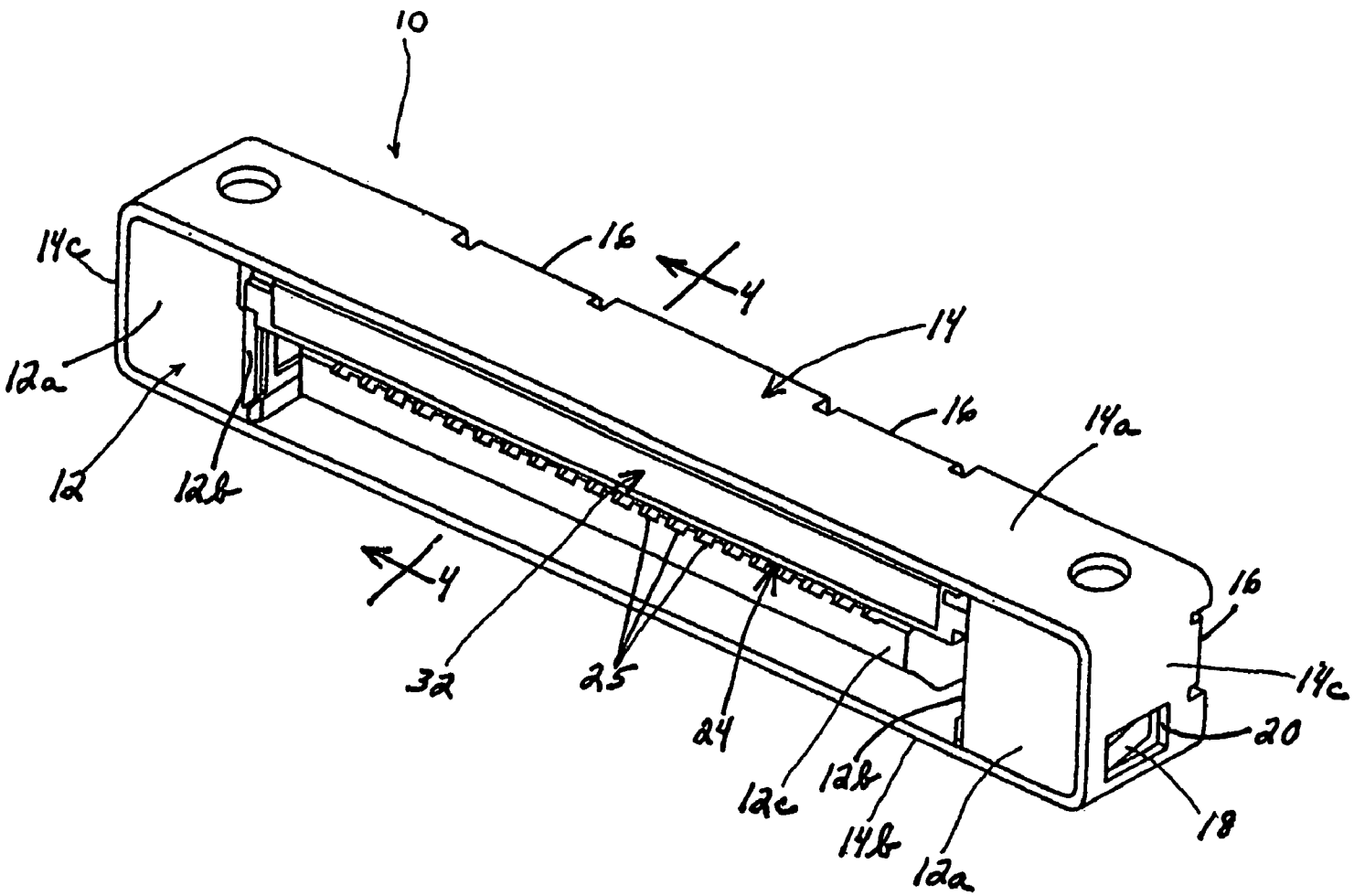
FIG. 1 is a perspective view of an electrical connector according to the invention.
Figure 2:
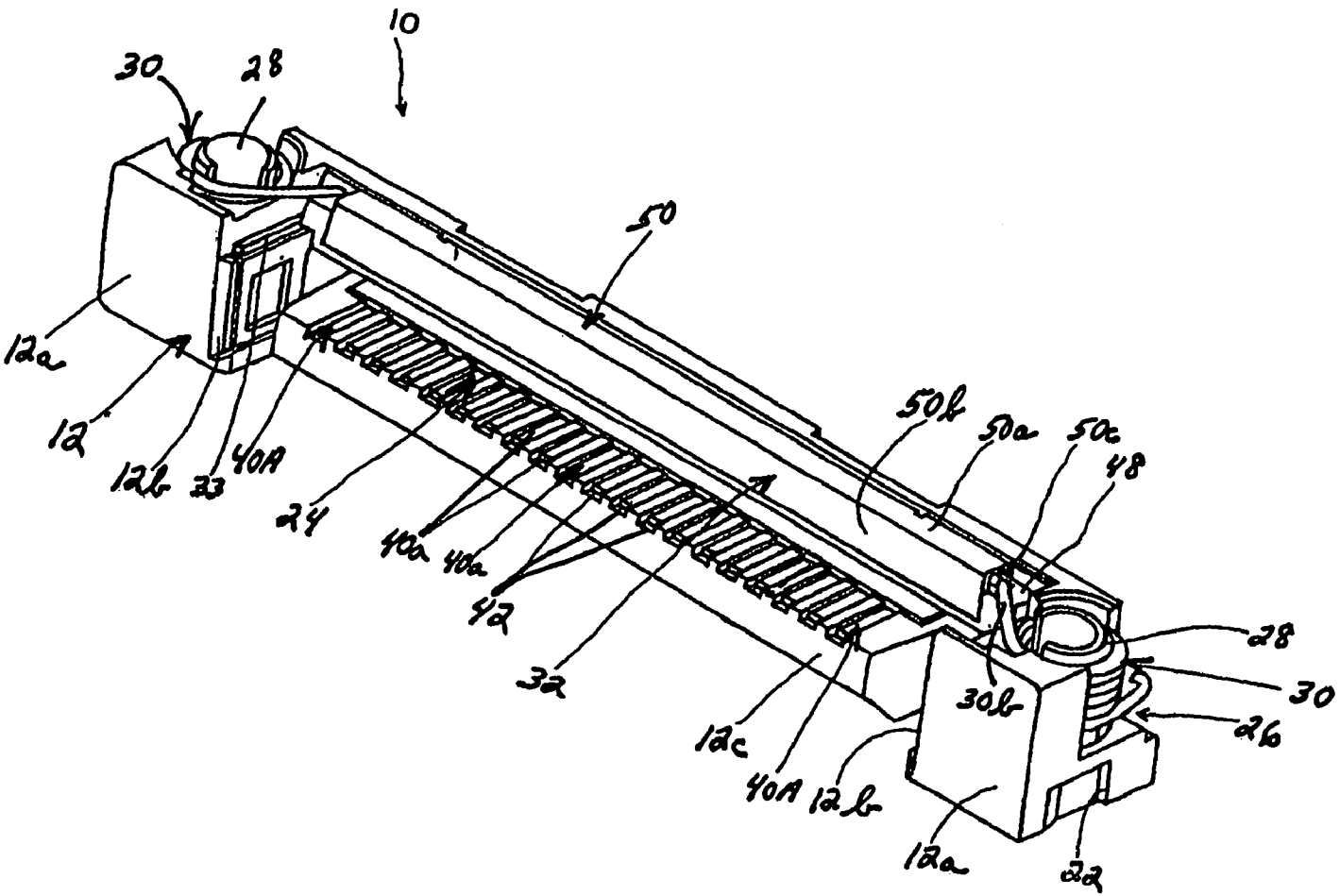
FIG. 2 is a perspective view of the electrical connector of FIG. 1, with the metal shell removed and the shutter plate moved to its open position.

Referring to the drawings in greater detail, and first to FIGS. 1 and 2, the invention is embodied in an electrical connector, generally designated 10, which includes an elongated dielectric housing, generally designated 12, substantially surrounded by a metal shell, generally designated 14, which encloses the top, bottom and opposite sides of the housing. In other words, metal shell 14 is in the form of a through shroud which exposes the front mating end and the rear end of the housing. The dielectric housing may be molded of dielectric material such as plastic or the like. The metal shell may be fabricated of stamped and formed sheet metal material.

As best seen in FIG. 1, metal shell 14, like housing 12, is elongated and includes a top wall 14*a*, a bottom wall 14*b* and opposite side walls 14*c*. A plurality of tabs 16 are bent inwardly from rear edges of all of the walls for engagement behind the dielectric housing. A pair of latch tabs 18 are stamped and formed out of openings 20 in side walls 14*c* of the metal shell for engaging latch surfaces 22 (FIG. 2) at opposite sides of the dielectric housing. Tabs 16 and 18 securely hold the metal shell about the dielectric housing.

As best seen in FIG. 2, dielectric housing 12 includes a pair of side blocks 12*a* which have inside faces 12*b*. A terminal mounting platform 12*c* of the housing projects forwardly and cooperates with side blocks 12*a* and inside faces 12*b* of the housing to define an elongated receptacle area, generally designated 24.

The rear of side blocks 12*a* of dielectric housing 12 define coil spring seating areas, generally designated 26, as seen at the right-hand end of FIG. 2. An upstanding mounting post 28 is disposed in each coil spring seating area. A coil spring, generally designated 30, is mounted onto and about each post 28, for purposes described hereinafter. The coil springs are conductive, as of metal material.

An elongated shutter member or plate, generally designated 32, is movably mounted on housing 12 for movement between a closed position shown in FIG. 1 and an open position shown in FIG. 2. In the closed position (FIG. 1) of the shutter plate, the plate substantially closes receptacle 24 to prevent inadvertent engagement of foreign objects with contact portions of terminals (described hereinafter) exposed within the receptacle. In the open position (FIG. 2) of the shutter plate, a complementary mating connector (described hereinafter) is mateable with the connector and has appropriate contacts for engaging the exposed contact portions of the terminals within receptacle 24. The shutter plate is movable along a pair of guide rails 33 formed on the inside faces of side blocks 12*a* of the housing, as seen in FIG. 2.

Figure 3:
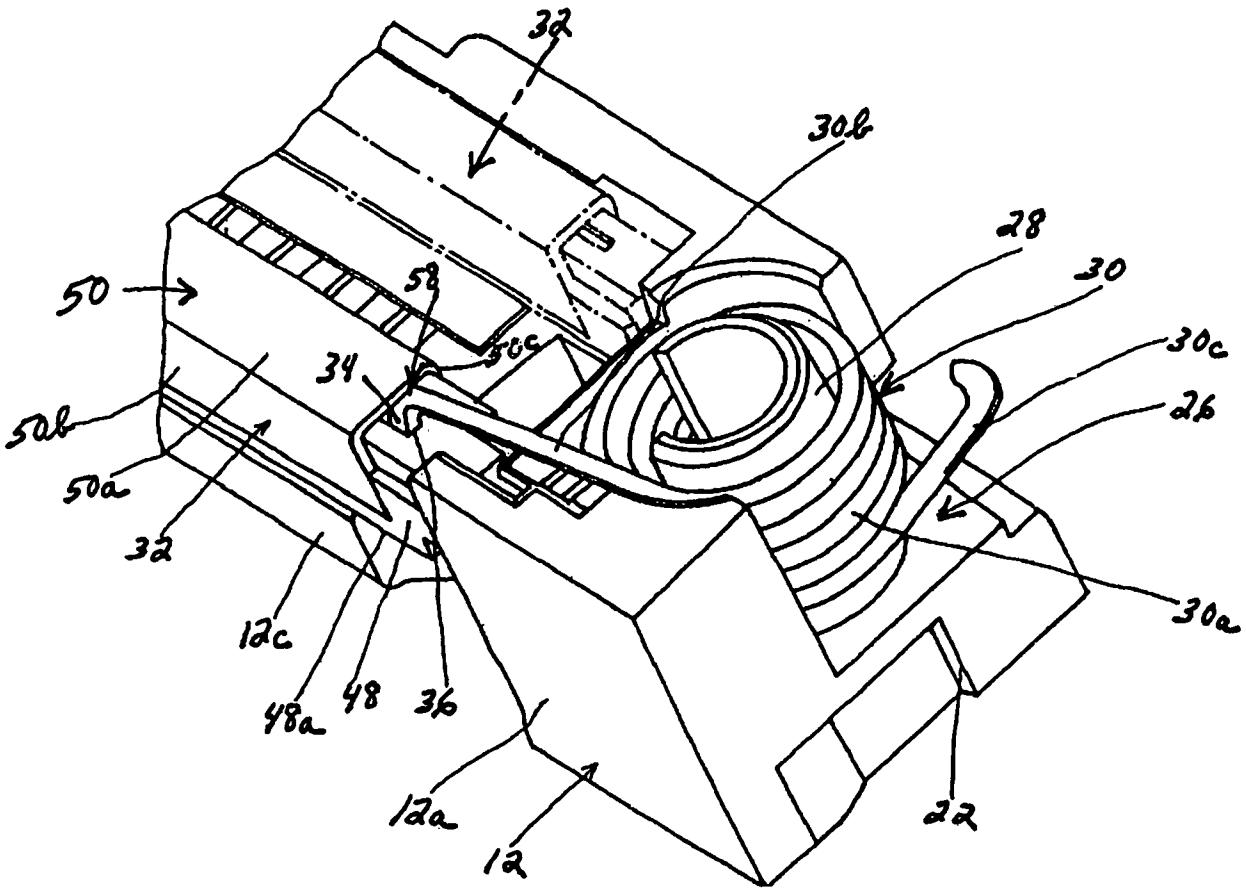
FIG. 3 is an enlarged, fragmented perspective view of the right-hand end of FIG. 1, but with the shutter plate in its closed position.

Referring to FIG. 3 in conjunction with FIG. 2, each coil spring 30 includes a coiled portion 30*a* wrapped around a respective one of the mounting posts 28. An inner end 30*b* of the coil spring is engageable with shutter member 32, and an outer end 30*c* of the coil spring is engageable with the inside of one of the side walls 14*c* (FIG. 1) of metal shell 14. When the opposite ends of the coil spring are so engaged, the coil spring is "cocked" to bias shutter plate 32 toward its closed position as shown in FIG. 3. To this end, an angled tip 34 (FIG. 3) of inner end 30*b* of the coil spring is seated into a hole 36 in the top of shutter plate 32.

Figure 4:
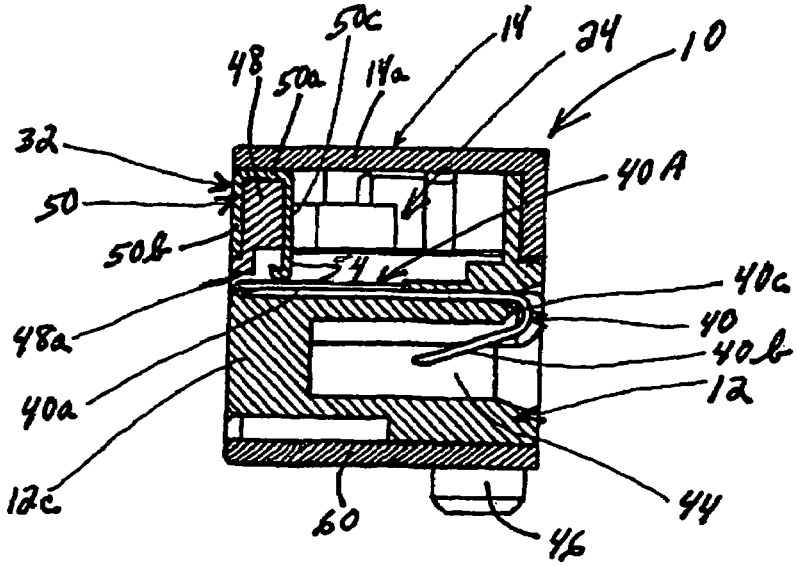
FIG. 4 is a vertical section taken generally along line 4—4 of FIG. 1.

Referring to FIG. 4 in conjunction with FIG. 2, a plurality of conductive terminals, generally designated 40, are mounted on housing 12 and are spaced in a side-by-side relationship longitudinally of elongated receptacle 24. Each terminal includes a contact portion 40*a* exposed within receptacle 24. Specifically, each contact portion 40*a* is disposed in a slot 42 in the top surface of terminal mounting platform 12*c* of the housing as is best seen in FIG. 2. Each terminal is generally U-shaped and includes a second contact portion 40*b* joined to the first contact portion by a bent portion 40*c*. Second contact portions 40*b* of the terminals extend downwardly into a rear receptacle 44 (FIG. 4) of the housing for receiving another complementary connecting device. For purposes described hereinafter, and referring back to FIG. 2, a pair of end-most terminals, generally designated 40A, are provided as ground terminals. Connector 10 may be adapted for mounting on a printed circuit board, such as by mounting posts 46 (FIG. 4), and the ground terminals would be connected to appropriate ground circuit traces on the printed circuit board.

FIG. 4 also shows the construction of elongated shutter plate 32. Specifically, the shutter plate includes an elongated dielectric core 48 which may be fabricated of plastic material. The top and opposite sides of the core are covered by a generally U-shaped conductive metal cover, generally designated 50. The cover may be stamped and formed of conductive metal material to include a top wall 50*a*, a front wall 50*b* and a rear wall 50*c*. That leaves a bottom face 48*a* of the dielectric core facing terminals 40 and 40*a*. As seen in FIG. 4, metal cover 50 includes a pair of J-shaped feet 54 for engaging ground terminals 40*a* to common the ground terminals with the conductive metal cover of shutter plate 32.

Referring back to FIG. 3 in conjunction with FIG. 4, when the inner ends 30*b* of conductive coil springs 30 are seated in holes 36 is dielectric core 48 of shutter plate 32, these inner ends of the conductive coil springs are maintained in engagement, as at 58 (FIG. 3), with conductive cover 50 of the shutter plate. Since the opposite ends 30*c* of the conductive coil springs are in compressive engagement with end walls 14*c* of metal shell 14, the coil springs perform a dual function of biasing the shutter plate to its closed position as well as grounding the shutter plate, via the coil springs, to the metal shell. If the connector is mounted on a printed circuit board, a bottom wall 60 (FIG. 4) of the metal shell can be maintained in contact with ground circuit traces on the printed circuit board. By grounding metal cover 50 of the shutter plate to the metal shell, via conductive coil springs 30, static electricity at receptacle 24 and around contact portions 40*a* of terminals 40 is completely dissipated.

Inner ends 30*b* of coil spring 30 (as shown best in FIG. 3) also are effective to bias shutter plate 32 downwardly to bias feet 54 (FIG. 4) of the metal cover of the shutter plate into engagement with ground terminals 40*a*. In addition, although FIGS. 4 and 5 do not quite clearly show a gap between top wall 50*a* of metal cover 50 and top wall 14*a* of metal shell 14, the downwardly biasing affect of inner ends 30*b* of the coil springs is effective to prevent the metal cover from rubbing on the metal shell which, otherwise, might create metal dust.

Figure 5:
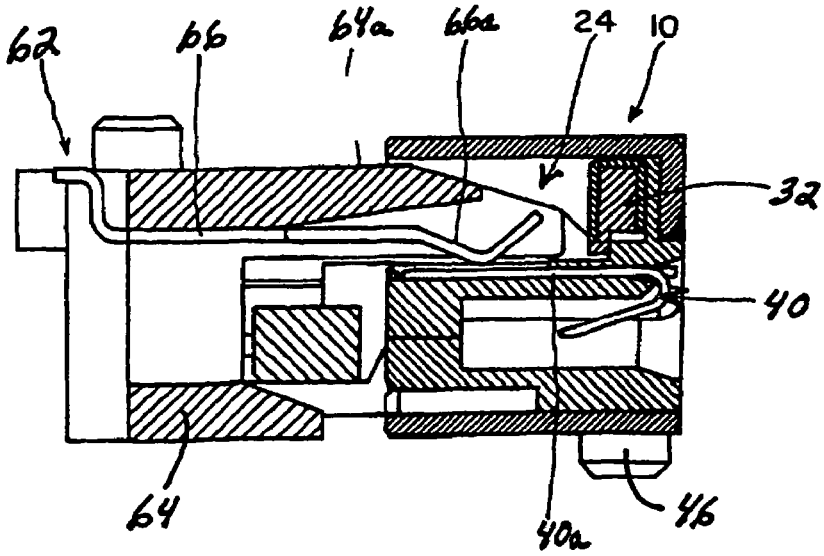
FIG. 5 is a view similar to that of FIG. 4, but showing a mating connector inserted into the connector and moving the shutter plate to its open position.

Finally, FIG. 5 shows a complementary mating connector, generally designated 62, mated with connector 10. The mating connector includes a dielectric housing 64 having a plug portion 64*a* which is inserted into receptacle 24. A plurality of terminals 66 are mounted in housing 64 and have contact portions 66*a* for engaging contact portions 40*a* of terminals 40 of connector 10. Although not visible in FIG. 5, plug portion 64*a* of mating connector 62 engages shutter plate 32 to move the shutter plate from its protective closed position shown in FIG. 4 to its open position shown in FIG. 5 as the mating connector is mated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector (10), comprising:

a dielectric housing (12) having a receptacle (24) for receiving a complementary mating connector (62);

a plurality of conductive terminals (40) mounted on the housing and having contact portions (40*a*) exposed in the receptacle for engaging appropriate contacts (66) of the mating connector;

a metal shell (14) about at least a portion of the housing;

a shutter plate (32) movably mounted on the housing for movement between a closed position substantially closing said receptacle to prevent inadvertent engagement of foreign objects with the contact portions of the terminals and an open position allowing mating of said complementary mating connector, at least a portion (50) of the shutter plate being conductive to dissipate static electricity at the receptacle; and at least one spring (30) mounted on the housing for biasing the shutter plate toward its closed position, the spring being conductive and electrically coupled between the conductive portion of the shutter plate and the metal shell to ground the plate to the shell;

characterized in that said spring comprises a coil spring (30) having opposite ends **(30*b*, 30*c*) maintained in engagement with the conductive portion (50) of the shutter plate and the metal shell (14)**.

2. The electrical connector of claim 1 wherein said shutter plate (32) is elongated, and including a pair of said coil springs (30) located at opposite ends of the elongated shutter plate.

3. The electrical connector of claim 1 wherein said shutter plate (32) includes a dielectric core (48) and said conductive portion of the shutter plate comprises a metal cover (50) over at least part of the dielectric core.

4. The electrical connector of claim 3 wherein said dielectric core (48) of the shutter plate includes an inside face **(48*a*) which faces the contact portions (40*a*) of the terminals (40)**.

5. The electrical connector of claim 1 wherein at least one of said terminals is provided as a ground terminal (40A) and is in engagement with the conductive portion (50) of the shutter plate, thereby coupling the ground terminal, via the conductive spring (30), to the metal shell (14).

6. The electrical connector of claim 5 wherein said conductive portion (50) of the shutter plate (32) includes a foot (54) extending into engagement with said at least one ground terminal (40A).

* * * * *